US005860350A

United States Patent [19]

Rexroad

[11] Patent Number: 5,860,350

[45] Date of Patent: Jan. 19, 1999

[54] FLAT BRAID WITH WEB CORE

[76] Inventor: John Rexroad, 12 Jackson Rd., Killingworth, Conn. 06419

[21] Appl. No.: 789,416

[22] Filed: Jan. 29, 1997

[51] Int. Cl.[6] ..... D04C 1/00

[52] U.S. Cl. ..... 87/6; 87/7; 87/11; 87/12; 87/13

[58] Field of Search ..... 87/5, 6, 7, 8, 9, 87/11, 12, 13

[56] References Cited

U.S. PATENT DOCUMENTS

| | | | |
|---|---|---|---|
| 1,700,192 | 1/1929 | Appleyard . | |
| 2,094,919 | 10/1937 | Hughes | 87/6 |
| 2,194,865 | 3/1940 | Mizugoshi | 96/23 |
| 2,407,031 | 9/1946 | Morcaldi D' | 87/11 |
| 2,600,395 | 6/1952 | Domoj et al. | 87/13 |
| 2,659,956 | 11/1953 | Lilienfeld | 28/78 |
| 2,792,617 | 5/1957 | Haller | 28/78 |
| 2,817,263 | 12/1957 | Pedley et al. | 87/13 |
| 2,823,576 | 2/1958 | Needham et al. | 87/1 |
| 3,039,348 | 6/1962 | Grabowsky et al. | 87/12 |
| 3,047,860 | 7/1962 | Swallow et al. | 343/18 |
| 3,170,611 | 2/1965 | Gullen | 224/42.1 |
| 4,000,344 | 12/1976 | Dilbey | 87/12 |
| 4,158,985 | 6/1979 | Looker et al. | 87/12 |
| 4,257,309 | 3/1981 | Dunahoo | 87/12 |
| 4,619,108 | 10/1986 | Hotta | 57/236 |
| 4,622,094 | 11/1986 | Rexroad | 87/9 |
| 4,651,620 | 3/1987 | Lyons | 87/12 |
| 4,892,210 | 1/1990 | Kupersmit | 220/1.5 |
| 4,895,366 | 1/1990 | Bartasius | 273/29 B |
| 4,948,129 | 8/1990 | Bartasius | 273/29 B |
| 5,134,030 | 7/1992 | Ueda et al. | 87/6 |
| 5,240,769 | 8/1993 | Ueda et al. | 87/9 |
| 5,255,262 | 10/1993 | Leduc | 87/9 |
| 5,328,310 | 7/1994 | Lockney | 410/97 |

FOREIGN PATENT DOCUMENTS 879729 2/1942 France .

OTHER PUBLICATIONS 11 page brochure, PUCUDA™ FUN, Sep. 1996 Pucuda, Inc.

*Primary Examiner*—William Stryjewski
*Attorney, Agent, or Firm*—Perman & Green, LLP

[57] ABSTRACT

A member for use in net construction comprises a sheathing with an internal core, the internal core has a very low stretch capacity and the outer sheathing has a much larger stretch capacity but allows intersplicing of crossing members within the lattice or between a border member comprised of such a material and the free end of the weft and warp members.

12 Claims, 5 Drawing Sheets

FLAT BRAID WITH WEB CORE

CROSS REFERENCE TO RELATED APPLICATIONS

The present invention relates to copending U.S. application Ser. No. 08/153,623 entitled Improved Climbing Net, filed in the name of Rexroad et al. on Nov. 17, 1993 and also relates to U.S. application Ser. No.: 08/414,185 entitled Hollow Braid Net and Method of Making, filed Mar. 31, 1995, now U.S. Pat. No. 5,622,094 and further relates to U.S. application Ser. No. 08/557,851, now U.S. Pat. No. 5,752,459 entitled Net With Flattened surface Members Connected At Sewn Intersections.

BACKGROUND OF THE INVENTION

The present invention relates to a material used in the formation of nets, and is more particularly related to an improvement in such material wherein the material has improved stretch resistant characteristics allowing a net constructed therefrom to be a more stable device yet still provide a nonabrasive outer surface.

Conventional net constructions have had application for use as climbing nets and/or as nets for recreational purposes, such as found in playscapes or the like for children. The perpendicularly intersecting lengths of cord or other continuous elongate members which connect at intersections generate a generally square mesh like structure. The squares, or other closed shapes of the mesh structure are used to grab, step, hold or otherwise provide a structural support for the individual who is using the device or the item which is being supported by the net structure. For example, in a net which is hung vertically for climbing purposes, downwardly applied forces are distributed both vertically and laterally through the net lattice. In addition to the force loading requirements of a net structure, it is also desirable to construct a net from a material which is of a nonabrasive construction so as to not scratch or abrade the exposed skin of the individual who is engaged with the net. This is most important in the application of the net where it is used for amusement purposes with children. As is set forth in copending U.S. application Ser. No. 08/153,624, entitled, Improved Climbing Net, it is disclosed in that application to use a non-abrasive material in the net construction such as a multi-filament polypropylene ethylene copolymer which avoids problems with netting material which is abrasive to the touch. However, such netting material has problems inherent to the twisted construction of each of the elongated members. That is, in order for the ends of the lengths of cordage to terminate, the lengths are usually heated in order to melt the plastic and prevent unraveling of the multi-filaments. These heated end portions tend to be sharp and leave hard knobs and defeat the non-abrasive character of the over all netting. Also, the twisted cylindrical shape is harder to grasp by a child than a flattened design.

In copending U.S. application Ser. No. 08/557,851, entitled Net With Flattened surface Members Connected At Sewn Intersections, it is disclosed to employ a net having elongated members which are of a tape-like configuration. That is, the net is formed from a flattened braided multi-filament material which is easier to grab and hold by the young hand of a child as opposed to the larger more rigid cylindrical shape of a twisted rope. The problem experienced with such braided tape-like elongated cordage members, and to some degree with the cylindrically twisted type rope, is that both tend to allow slack to prevail when loaded. In the case of the cylindrical twisted rope members, the twisted member tends to want to untwist and give up slack, and hence stretch. Likewise, the braid configuration has a loosely fitted braid intersecting matrix which when loaded tightens on itself thereby also giving up slack and stretching.

Accordingly, it is an object of the present invention to provide net cordage material which is of a tape-like construction and formed from a material nonabrasive to the touch by a human hand.

It is yet a further object of the invention to provide a net of the aforementioned type wherein the netting component is formed from a compound material defined by a smooth piercable unabrasive outer sheathing enclosing within a strengthening web core.

It is still a further object of the present invention to provide a net cord of the aforementioned type wherein the outer sheathing of the cord is formed from a material which is color fast in resistance to ultraviolet radiation.

SUMMARY OF THE INVENTION

The invention resides in an improved cordage member for use in net construction. The flexible member for netting comprises a sheathing having a generally elongate extent extending with a longitudinal axis, the sheathing having a generally rectangular shape as seen in end view and being generally defined by first and second spaced long sides extending parallel to one another and by first and second short sides each connected to and extending generally perpendicularly to the first and second long sides and extending parallel to one another to define therewithin a hollow internal confine therewithin. An elongate core member having a generally tape-like configuration located within the hollow internal confine of the sheathing so that the elongate extent of the core member extends coextensively with the elongate extent of the sheathing member as taken along the longitudinal axis. A means is provided for interconnecting the sheathing to the core member.

Ideally, the sheathing is a hollow braided member which is capable of being pierced through any one of the long and short sides and the means for interconnecting the sheathing to the core member core member being stitching. Also, the core member is preferably formed from a nylon web and the sheathing member being formed from a braided multi-filament material and the sheathing multi-filament material being formed from a color-fast polypropylene material.

Preferably, the member is used in a lattice of a plurality of the members disposed coplanar with one another and intersecting at predetermined angles and being box stitched at the intersections thereof and the intersecting members define weft and warp members of the lattice, each of the weft and warp members having free end portions which connect to a border member enclosing the lattice.

In one embodiment, the border member is comprised of an endless loop of defined by one of the plurality of the members with the free ends of the one of the plurality of the members being intertucked with one another and box stitched thereto. The weft and warp members may interconnect by cross piercing each other at nodes. The weft and warp members of the plurality of members may connect to the border such that the long side faces thereof are disposed parallel and generally coplanar with one another and the border member flat long sides being disposed perpendicularly to the plane which includes the weft and warp members.

Another aspect of the invention reside in providing a plurality of the members each having free end portions, the free end portion of one of the plurality of members piercing the sheathing of the other of the plurality of members in the vicinity of the free end portion thereof, and the free end portion of the one of the plurality of members piercing the sheathing of the other of the plurality of members in the vicinity of the free end portion thereof and each piercing portion being left within the internal hollow confine of the members and being stitched in place therein.

The invention also resides in a net comprising a plurality of generally flat elongated weft and warp members each having a generally rectangular shape as seen in end view and being generally defined by first and second spaced long sides extending parallel to one another and by first and second short sides each connected to and extending generally perpendicularly to the first and second long sides and extending parallel to one another; the weft and warp members connect to one another at intersections therebetween such that the long sides of each of the weft and warp members contact one another to effect a generally coplanar lattice of interconnecting weft and warp members. A border member is arranged about the intersecting weft and warp members and each of the weft and warp members having opposite free end which are connected to the border member. The border member has a generally rectangular shape as seen in end view and is generally defined by first and second spaced long sides extending parallel to one another and by first and second short sides each connected to and extending generally perpendicularly to the first and second long sides and extending parallel to one another, and the first and second long sides of the border member are disposed perpendicularly to the plane of the lattice of interconnecting weft and warp members.

DETAILED DESCRIPTION OF THE PREFERRED EMBODIMENT

Figure 1:
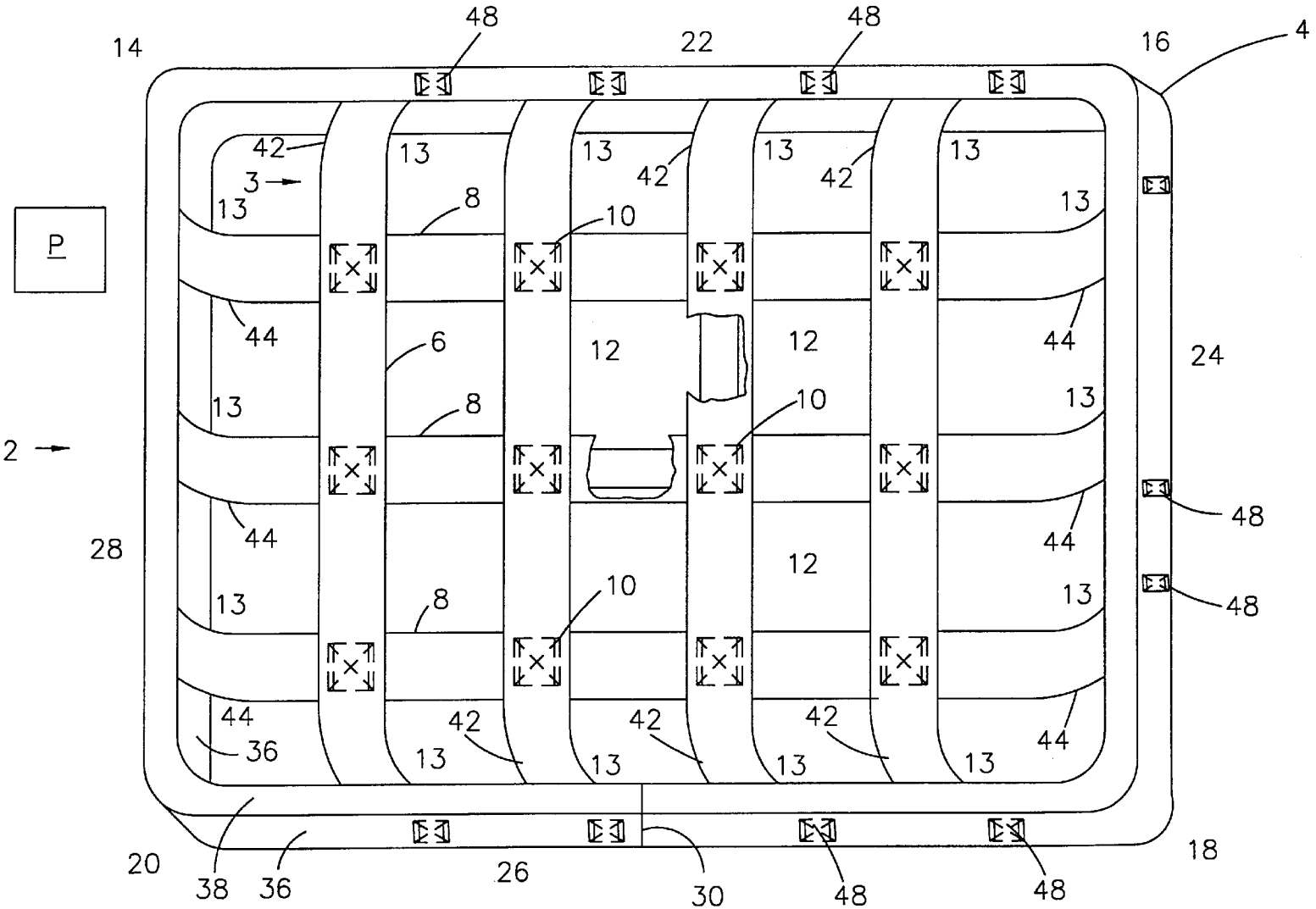
FIG. 1 is a partially fragmentary isometric view showing the improved cordage members in a net construction lattice which is of a planar configuration oriented perpendicularly to the border member.

FIG. 1 illustrates a net reference generally as 2. The net 2 is defined by a net lattice 3 and a border member 4,4'. The net lattice and the border member as disclosed herein are comprised of an improved flexible cordage member 1 which is illustrated separately as element 1 in FIG. 4. The lattice 3 is thus comprised of a plurality of weft members 6,6 extending in one direction and a plurality of warp members 8, 8 extending orthogonally thereto, each of which weft and warp members being each comprised of the improved cordage member 1. Furthermore, although the present disclosure seeks to describe the invention in its preferred embodiments, it is well within the purview of the invention to form a lattice by intersecting the weft and warp members at angles other than at the illustrated ninety degree orientation shown in the figures, particular with respect to the flattened sewn intersection of FIGS. 2 and 3, wherein the orientation of the weft and warp members can be easily fixed by sewing.

The weft and the warp members intersect and are connected with one another at nodes 10,10. The weft and warp members 6,6 and 8,8, respectively, interconnect with the border member at points 13,13, and, depending upon the type of net construction chosen, connect in different manners, which will be discussed in greater detail later. The weft, warp and border members taken together more importantly create rows and columns of boxes, or closed shapes, 12,12 arranged in a matrix to generate the illustrated grid-like pattern shown in FIGS. 1 and 2.

The border member 4,4' encloses an area defining the lattice 3 of the net 2. For purposes of illustration, it should be seen that the border member is said to be defined by four corner points identified as 14, 16, 18 and 20. Each of these corner points when taken consecutively in pairs define a first border section 22, extending between points 14 and 16, a second border section 24 extending between points 16 and 18, a third border section 26 extending between points 18 and 20 and a fourth border section 28 which extends between points 20 and 14.

Figure 6:
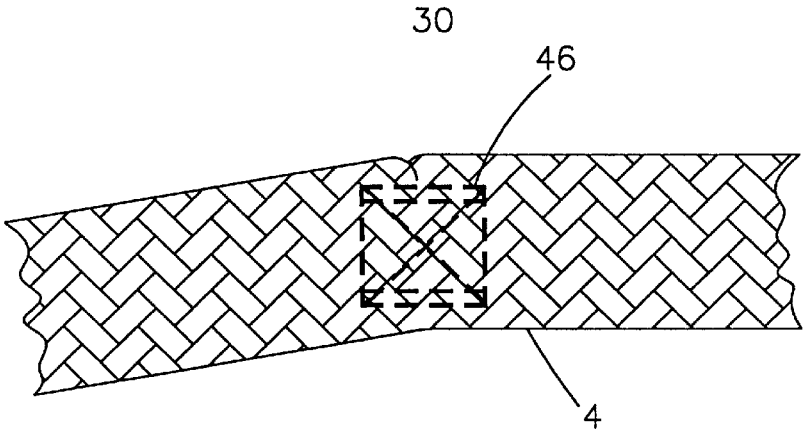
FIG. 6 is an end to end splice using a cordage member of the present invention.

In the embodiment of FIG. 1, the border 4 is itself comprised of a single length of the cordage 1 spliced end to end at a point 30 in the manner illustrated in FIG. 6. and is oriented perpendicularly to the plane P of the lattice 3. Alternatively, the border member 4' can be disposed in the plane P with the lattice 3, and may be made up of four separate pieces which are overlapped at the corners 14, 16 18 and 20, or, alternatively the border can be a single piece which is folded at a forty-five degree angle to make the right angle turn between, for example sections 22 and 24.

Figure 4:
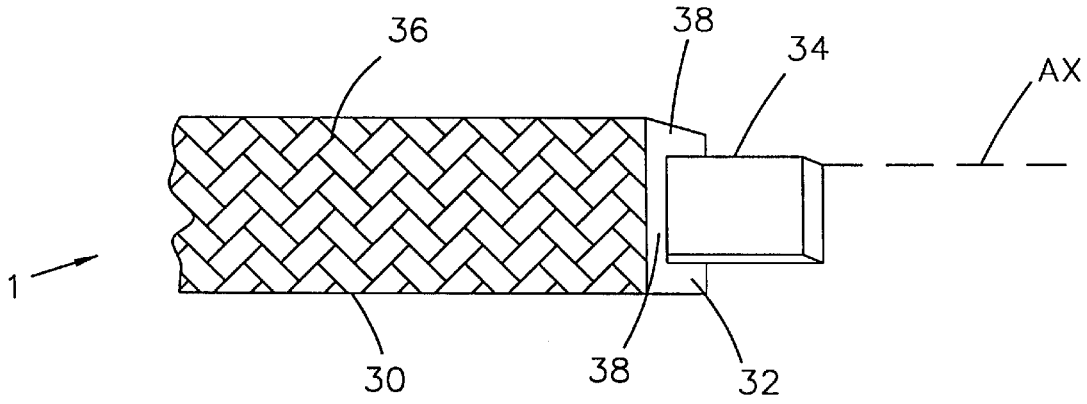
FIG. 4 is a fragmentary perspective view showing the improved cordage member apart from a constructed net.

Referring now to FIG. 4, and to the detailed construction of the cordage member 1, it should be seen that the member 1 is a generally elongated member extending along a longitudinal axis AX and is comprised of an outer sheathing 30 defining a hollow inner confine 32, which as seen in front end view, is somewhat rectangular in shape. Disposed within the hollow confine 32 of the sheathing member 30 is a core member 34 which extends coextensively with the length of the sheathing member 30. In the illustrative embodiment of FIG. 4, the sheathing has been cut away to reveal the internal core member 34, but normally both members are coextensive with one another.

The sheathing member 30 has two generally parallel disposed long side faces 36 and 36 which extend parallel to the longitudinal axis LA of the member 1, and has short side faces 38,38 which are formed so as to be disposed perpendicularly to the long side faces 36,36. The sheathing member is in the preferred embodiment a 11/16" color-fast diamond braided multi-filament polypropylene hollow rope which is a commercially available part sold by Gulf Rope and Cordage, Inc. of Mobile, Ala. under part No. 30822-07-3311A. The core member 34 is a tape-like webbing which is manufactured by Elizabeth Webbing Mills Company, Inc., Roosevelt Avenue, Central Falls, R.I. as part No. 7650. The core member 34 preferably is a nylon webbing with a width of approximately 0.5 inch and having an average thickness of 0.065 inch. The core member 34 has a tinsel strength rating of approximately 1,620 lbs. Alternatively, the core member 34 may be selected as a product also commercially sold by Wellington Synthetic Fibers Inc. of Leesville, S.C. under product No. N215Z.

Figure 2:
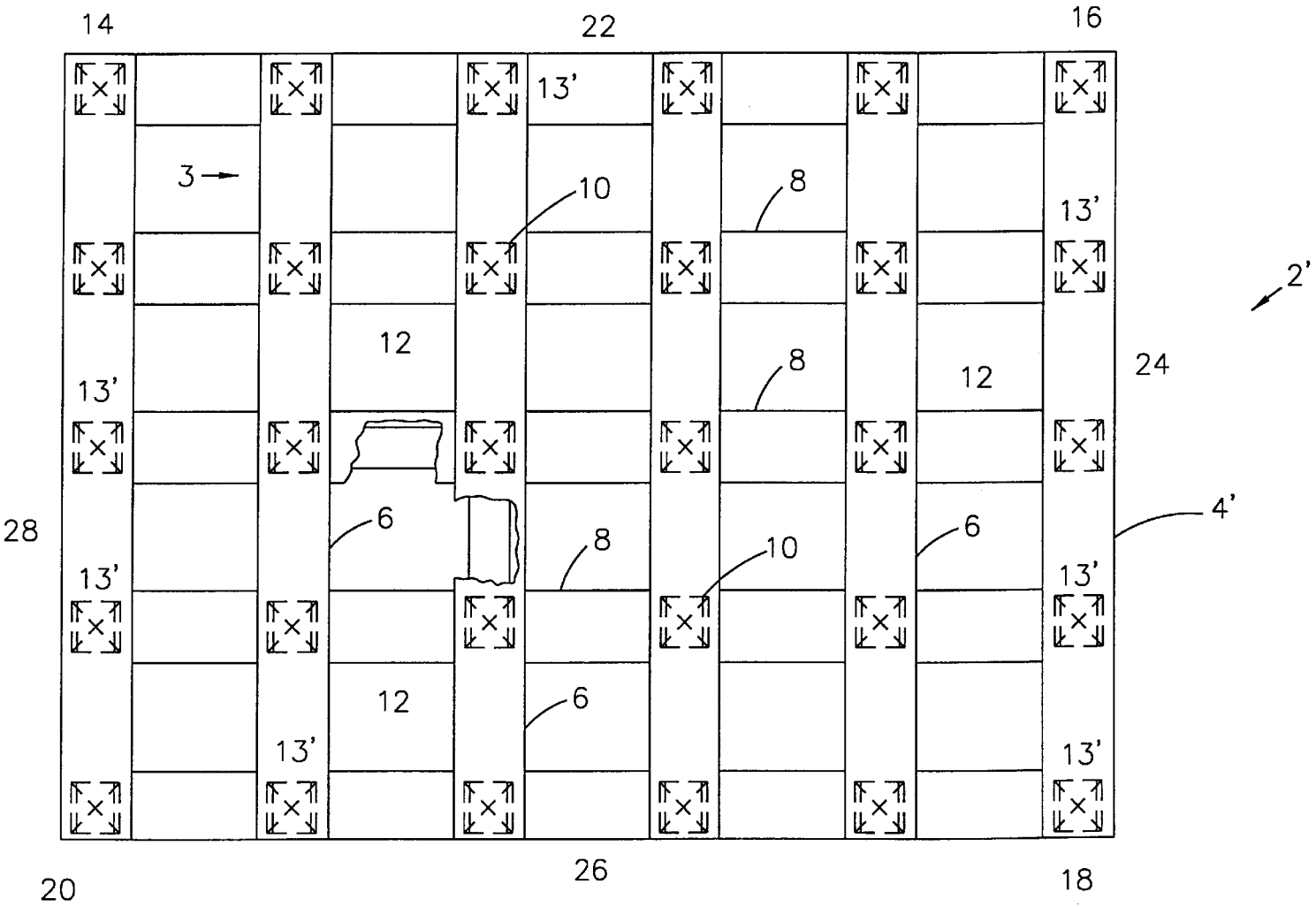
FIG. 2 is a partially fragmentary plan view of the improved cordage members of the invention as used in a square single plane lattice configuration.
Figure 3:
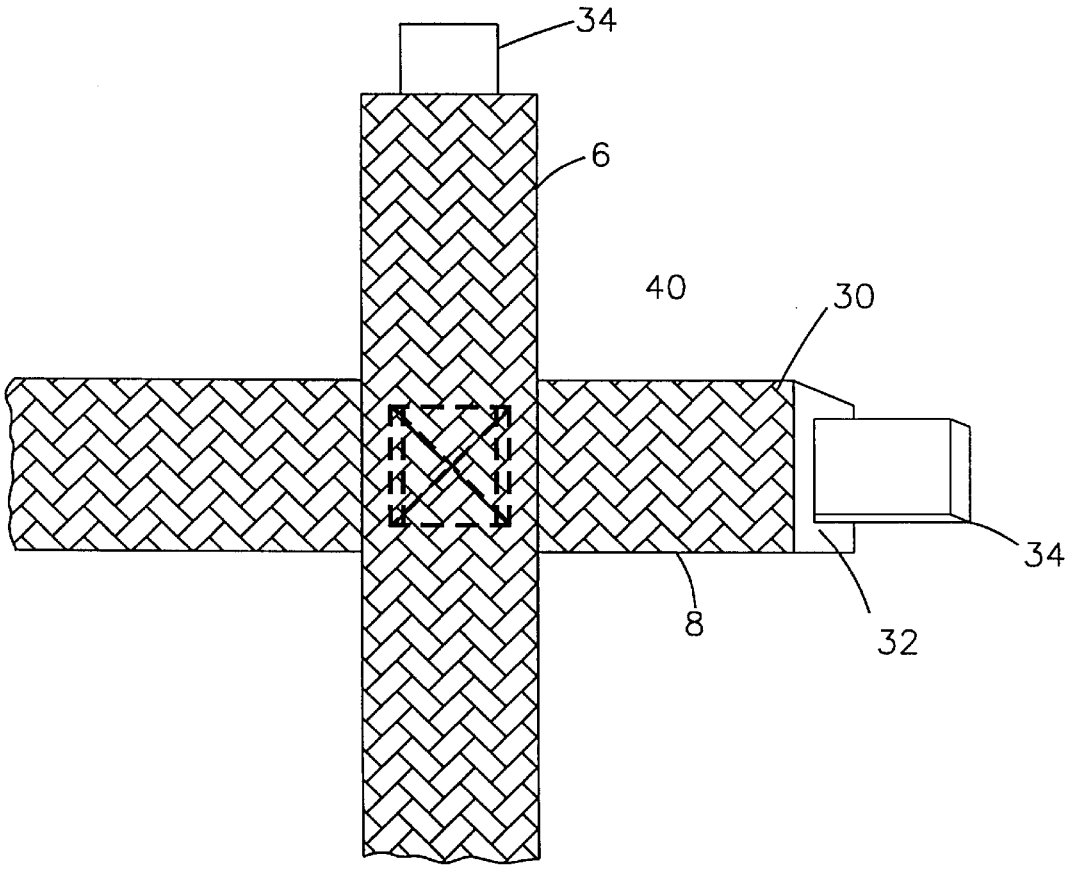
FIG. 3 is a top plan view of the intersection of a weft in a warp member of the lattice shown in FIGS. 1 and 2.

As illustrated in FIG. 3, the flattened configuration of the cordage members 1,1 allows a unique connection to be made between orthogonally disposed weft and warp members 6,6 and 8,8 through the intermediary of a stitch 40. That is, the weft and warp member connection illustrated in FIG. 3 is effected by laying one member 6 over the other 8 at a desired orientation, in this case at a ninety degree angle, and then and stitching the crossed members to one another by a box stitch 40. The box stitch 40 while not only effecting a connection between juxtaposed weft and warp members 6 and 8 further serves to fix the coaxially disposed core and sheathing members 30 and 34 in unity with one another. In this way, the sheathing 30 is maintained lengthwise in an almost a one to one positional correspondence with the corresponding length of the core member 34 disposed therewithin. As illustrated in FIG. 2, this sewn connection wherein members are layered one on the other and then stitched, also occurs at connections 13',13' between the border member 4' and respective ends of the weft and warp members 6,6 and 8,8.

Referring back to FIG. 1 and ahead to FIG. 6, it is a further object of the invention to use the improved cordage member 1 to form a continuous or endless loop making up the border member 4. The border member 4 as best illustrated in FIG. 6, has free ends each of which pierce the sheathing member 30 and extend into the confine 32 along the elongate dimension of the involved pierced member. Once each free end is tucked within the other in this manner, a box stitch 46 is made over the area of intersection to fix the intertucked free ends. For a further description of this end to end tuck type connection, reference may be had to copending U.S. application Ser. No. 08/557,851, entitled NET With Flattened surface Members Connected At Sewn Intersections.

As previously mentioned, the border member 4 in the embodiment of FIG. 1 is oriented such that the long flat side faces 36,36 thereof extend perpendicularly to the corresponding long sides faces 36,36 of the weft and warp members 6 and 8 which are stitched together in the illustrated manner of FIG. 3. The free end portions 42 and 44 of the weft and warp members connect to the border 4' by piercing into the border member through the innermost face 36 and each is thereafter pushed into the hollow confine 32 of the border member along the axial extent thereof. The length of the free end portions 42 and 44 of the weft and warp members which are received within the hollow confine of the border member is thereafter stitched at points 48,48 to terminate the respective free end portions of the weft and warp members therewithin. In this way, the net is free from exposed roughened edges of members which would otherwise connect to the border member 4 through normal splicing arrangements. It should be understood that each of the free end portions 42 and 44 of the weft and warp members undergoes a ninety degree twist between the plane P defined by the lattice of weft to warp members 6 and 8 and the respective connections to the border member 4 in order to orient the long flat faces 36,36 of the weft or warp members in parallel relation with the corresponding long faces 36,36 of the border member 4.

Figure 5:
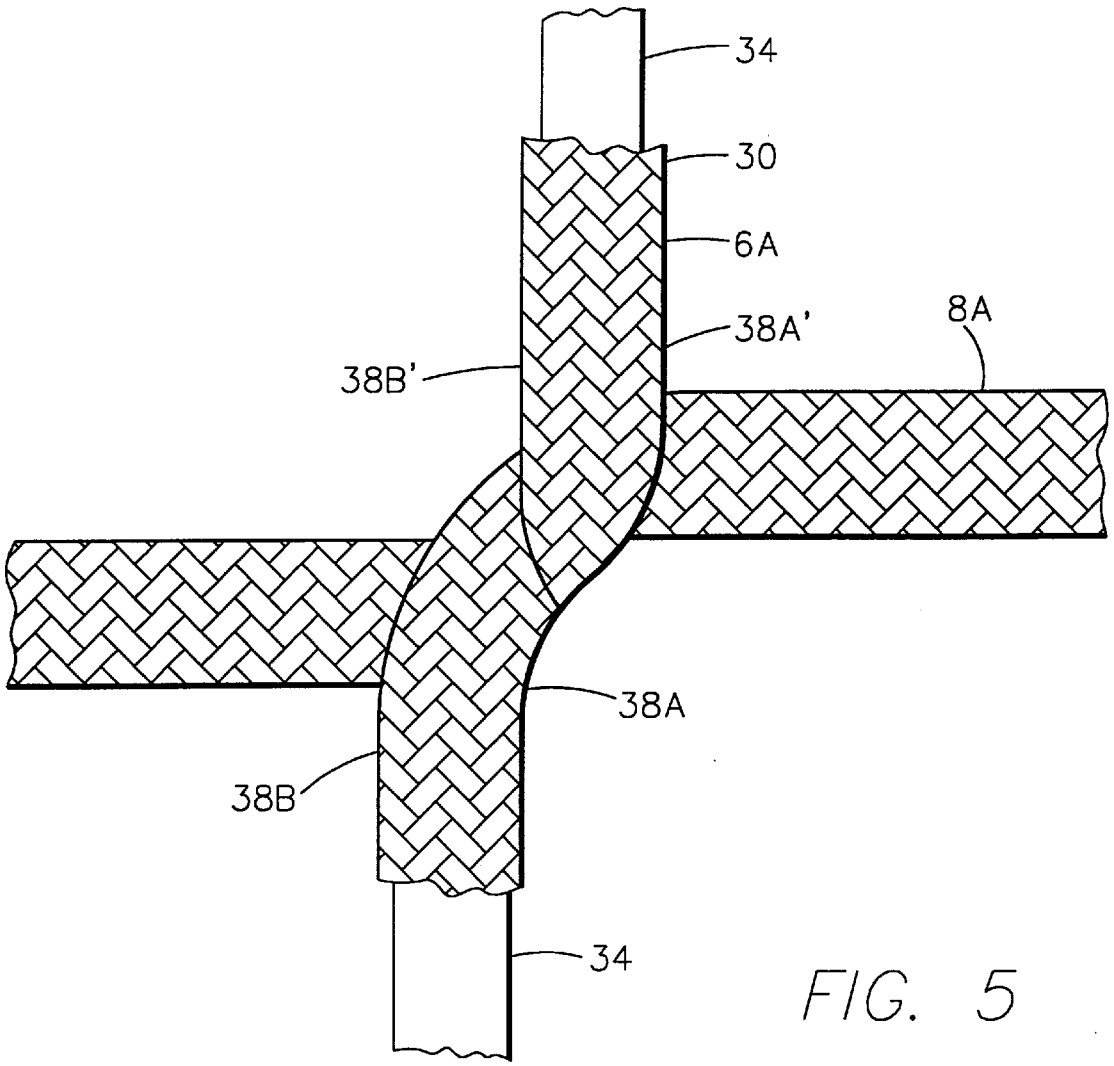
FIG. 5 is a top plan view of a knotted intersection between a weft and a warp member in a lattice construction of a net.

Referring now to FIG. 5, it should also be seen that the construction of the improved cordage members 1,1 further allows for weft and warp member 6,6 and 8,8 to connect with one another by a knotting, as opposed to a connection that is stitched. As illustrated in FIG. 5, weft member identified as 6*a* is caused to pierce the small side face 38*a* of the warp member 8*a* and pass into the hollow confine 32 thereof and generally perpendicularly through the member 8*a* and exit at the side 38*b*. In a like manner, the warp member 8*a* is caused to pierced the side 38*b*' of the weft member 6*a* and pass ninety degrees therethrough and exit side 38*a*'. It should be appreciate that the braided sheathing 30 which makes up the cordage member 1 is fully piercable and allows the piercing interconnections between the illustrated weft and warp members to occur. This is because the thickness and width profiles of the core members 34 are sufficiently small as to still allow room within the confine 32 for an inserted length of an intersecting weft or warp member. Thus, the internal construction of the cordage member 1 does not significantly increase the dimensions of the sheathing 30 from that which it is normally exhibits absent the core 34 disposed therein.

Accordingly, the invention has been described by way of illustration rather than limitation. For example, the core has been described in the illustrated embodiments as being comprised of a nylon material, however, the core may be made from a material such as polyester or polypropylene which is tightly enough formed to allow almost zero stretching. Also, while not specifically disclosed, it should be understood that the sheathing 30 can alternatively be formed from a braided nylon or polyester material, or the like. Additionally, while the invention has been described with the lattice 3 connecting to a border 4,4', it is well within the purview of the invention to used the improved cordage member 1 without a border, and instead to use other means of attaching the lattice to a frame or structure, such as, by looping the ends to effect such attachment.

The invention has thus been described in the preferred embodiment by way of illustration.

What is claimed is:

1. A flexible member for netting comprising:

a sheathing having a generally elongate extend extending with a longitudinal axis, said sheathing having a generally rectangular shape as seen in end view and being generally defined by first and second spaced long sides extending parallel to one another and by first and second short sides each connected to and extending generally perpendicularly to the first and second long sides and extending parallel to one another to define therewithin a hollow internal confine therewithin; and an elongate core member having a generally tape-like configuration located within said hollow internal confine of said sheathing and wherein the core is independently movable relative to the sheath and the sheath is independently movable relative to the core.

2. A member as defined in claim 1 further characterized by said sheathing being a hollow braided member which is capable of being pierced through any one of said long and short sides.

3. A member as defined in claim 2 further characterized by said core member being formed from a nylon web and said sheathing member being formed from a braided multi-filament material.

4. A member as defined in claim 3 further characterized by said sheathing multi-filament material being formed from a color-fast polypropylene material.

5. A member as defined in claim 3 further characterized by said member being one of a plurality of such members arranged in a lattice of plurality of said members disposed coplanar with one another and intersecting at predetermined angles and being stitched at the intersections thereof.

6. A member as defined in claim 5 further characterized in that said intersecting members define weft and warp members of said lattice, each of said weft and warp members having free end portions which connect to a border member enclosing said lattice.

7. A member as defined in claim 6 further characterized in that said border member is comprised of an endless loop of defined by one of said plurality of said members with the free ends of said one of said plurality of said members being intertucked with one another and box stitched thereto.

8. A member as defined in claim 7 further characterized by said weft and warp members being interconnected by cross piercing each other at nodes.

9. A member as defined in claim 8 further characterized in that the weft and warp members of said plurality of members are connected such that the long side faces thereof are disposed parallel and generally coplanar with one another and said border member flat long sides being disposed perpendicularly to said plane which includes said weft and warp members.

10. A member as defined in claim 1 further characterized by providing a plurality of said members each having free end portions, the free end portion of one of said plurality of members piercing said sheathing of said other of said plurality of members in the vicinity of the free end portion thereof, and the free end portion of the one of said plurality of members piercing said sheathing of said other of said plurality of members in the vicinity of the free end portion thereof and each piercing portion being left within said internal hollow confine of said members and being stitched in place therein.

11. A net comprising:

a plurality of generally flat elongated weft and warp members each having a generally rectangular shape as seen in end view and being generally defined by first and second spaced long sides extending parallel to one another and by first and second short sides each connected to and extending generally perpendicularly to the first and second long sides and extending parallel to one another;

said weft and warp members connecting to one another at intersections therebetween such that the long sides of each of said weft and warp members are disposed substantially flat and parallel with one another at said intersections to effect a lattice of generally coplanar interconnecting weft and warp members;

a border member arranged about said intersecting weft and warp members and each of said weft and warp members having opposite free ends which are connected to the border member; and wherein the border member has a generally rectangular shape as seen in end view and is generally defined by first and second spaced long sides extending parallel to one another and by first and second short sides each connected to and extending generally perpendicularly to the first and second long sides and extending parallel to one another, and the first and second long sides of said border member being disposed perpendicularly to the plane of the lattice of interconnecting weft and warp members.

12. A flexible member for netting comprising:

a sheathing having a generally elongate extent extending with a longitudinal axis, said sheathing having a generally rectangular shape as seen in end view and being generally defined by first and second spaced long sides extending parallel to one another and by first and second short sides each connected to and extending generally perpendicularly to the first and second long sides and extending parallel to one another to define therewith in a hollow internal confine therewithin;

an elongate core member having a generally tape-like configuration located within said hollow internal confine of said sheathing so that the elongate extent of said core member extends coextensively with the elongate extent of the sheathing member as taken along said longitudinal axis;

said sheathing being a hollow braided member which is capable of being pierced through any one of said long and short sides; and wherein said core member being formed from a nylon web and said sheathing member being formed from a braided multi-filament material.

* * * * *